US010947462B2

(12) United States Patent
Egolf et al.

(10) Patent No.: US 10,947,462 B2
(45) Date of Patent: Mar. 16, 2021

(54) CATALYST STAGING IN CATALYTIC REACTION PROCESS

(71) Applicant: UOP LLC, Des Plaines, IL (US)

(72) Inventors: Bryan J. Egolf, Crystal Lake, IL (US); Ian G. Horn, Streamwood, IL (US); David A. Wegerer, Arlington Heights, IL (US); Gregory R. Werba, Arlington Heights, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 15/947,579

(22) Filed: Apr. 6, 2018

(65) Prior Publication Data

US 2018/0223196 A1 Aug. 9, 2018

Related U.S. Application Data

(63) Continuation of application No. PCT/US2016/056507, filed on Oct. 12, 2016.
(Continued)

(51) Int. Cl.

| | |
|---|---|
| ***C10G 59/02*** | (2006.01) |
| ***C10G 35/06*** | (2006.01) |
| ***C10G 35/04*** | (2006.01) |
| ***C10G 35/12*** | (2006.01) |
| ***C10G 35/085*** | (2006.01) |

(52) U.S. Cl.
CPC ..... *C10G 59/02* (2013.01); *C10G 35/04* (2013.01); *C10G 35/06* (2013.01); *C10G 35/085* (2013.01); *C10G 35/12* (2013.01); *C10G 2300/104* (2013.01); *C10G 2300/1044* (2013.01); *C10G 2300/305* (2013.01); *C10G 2300/70* (2013.01); *C10G 2400/02* (2013.01); *C10G 2400/30* (2013.01)

(58) Field of Classification Search
CPC ..... C10G 59/02; C10G 35/085; C10G 35/12; C10G 35/04; C10G 35/06; C10G 2400/30; C10G 2300/70; C10G 2400/02; C10G 2300/305; C10G 2300/104
See application file for complete search history.

(56) References Cited

U.S. PATENT DOCUMENTS

| | | | | |
|---|---|---|---|---|
| 3,864,240 A | | 2/1975 | Stone | |
| 4,053,388 A | | 10/1977 | Bailey | |
| 4,069,136 A | * | 1/1978 | Peer | C10G 35/12 208/65 |
| 4,069,137 A | * | 1/1978 | Greenwood | C10G 35/12 208/65 |

(Continued)

FOREIGN PATENT DOCUMENTS

RU 2388794 C2 5/2010

OTHER PUBLICATIONS

Sa'idi et al., "Modeling and simulation of continuous Catalytic Regeneration (CCR) Process," International Journal of Applied Engineering Research, Dindigul (2011), 2(1), 115-124.

(Continued)

*Primary Examiner* — Randy Boyer
*Assistant Examiner* — Juan C Valencia

(57) ABSTRACT

A reforming process is described. The reforming process includes introducing a hydrocarbon stream comprising hydrocarbons having 5 to 12 carbon atoms into a reforming zone containing reforming catalyst, the reforming zone comprising at least two reformers, each reformer having a set of reforming operating conditions, to produce a reformate effluent, wherein the last reformer contains less catalyst than the next to the last reformer.

20 Claims, 1 Drawing Sheet

Related U.S. Application Data

(60) Provisional application No. 62/240,638, filed on Oct. 13, 2015.

(56) References Cited

U.S. PATENT DOCUMENTS

| | | | | |
|---|---|---|---|---|
| 4,146,465 | A | 3/1979 | Blazek, Sr. et al. | |
| 5,037,529 | A | 8/1991 | Dessau et al. | |
| 5,858,205 | A | 1/1999 | Huebner | |
| 6,106,696 | A | 8/2000 | Fecteau et al. | |
| 6,740,228 | B1 | 5/2004 | Verduijn et al. | |
| 2008/0131338 | A1 | 6/2008 | Salmon | |
| 2010/0243521 | A1* | 9/2010 | Peters | C10G 9/00 208/63 |
| 2012/0277500 | A1 | 11/2012 | Moser et al. | |
| 2012/0277511 | A1 | 11/2012 | Moser et al. | |
| 2013/0158311 | A1 | 6/2013 | Serban et al. | |
| 2013/0158320 | A1 | 6/2013 | Moser et al. | |

OTHER PUBLICATIONS

Mohaddecy et al., "Optimization of catalyst distribution in the catalytic naphtha reformer of Tehran refinery," Petroleum & Coal (2008), 50 (2), 60-68.

Rahimpour et al., "Progress in catalytic naphtha reforming process: A review," Applied Energy (2013), 109, 79-93.

International Preliminary Report on Patentability from corresponding PCT application No. PCT/US2016/056507, dated Apr. 17, 2018.

Written Opinion of the International Searching Authority from from corresponding PCT application No. PCT/US2016/056507, dated Jan. 24, 2017.

International Search Report from corresponding PCT application No. PCT/US2016/056507, dated Jan. 24, 2017.

Search Report from corresponding Russian application No. 2018117449, dated Apr. 4, 2019.

Office action from corresponding Indian application No. 201817014076, dated Jun. 20, 2019.

* cited by examiner

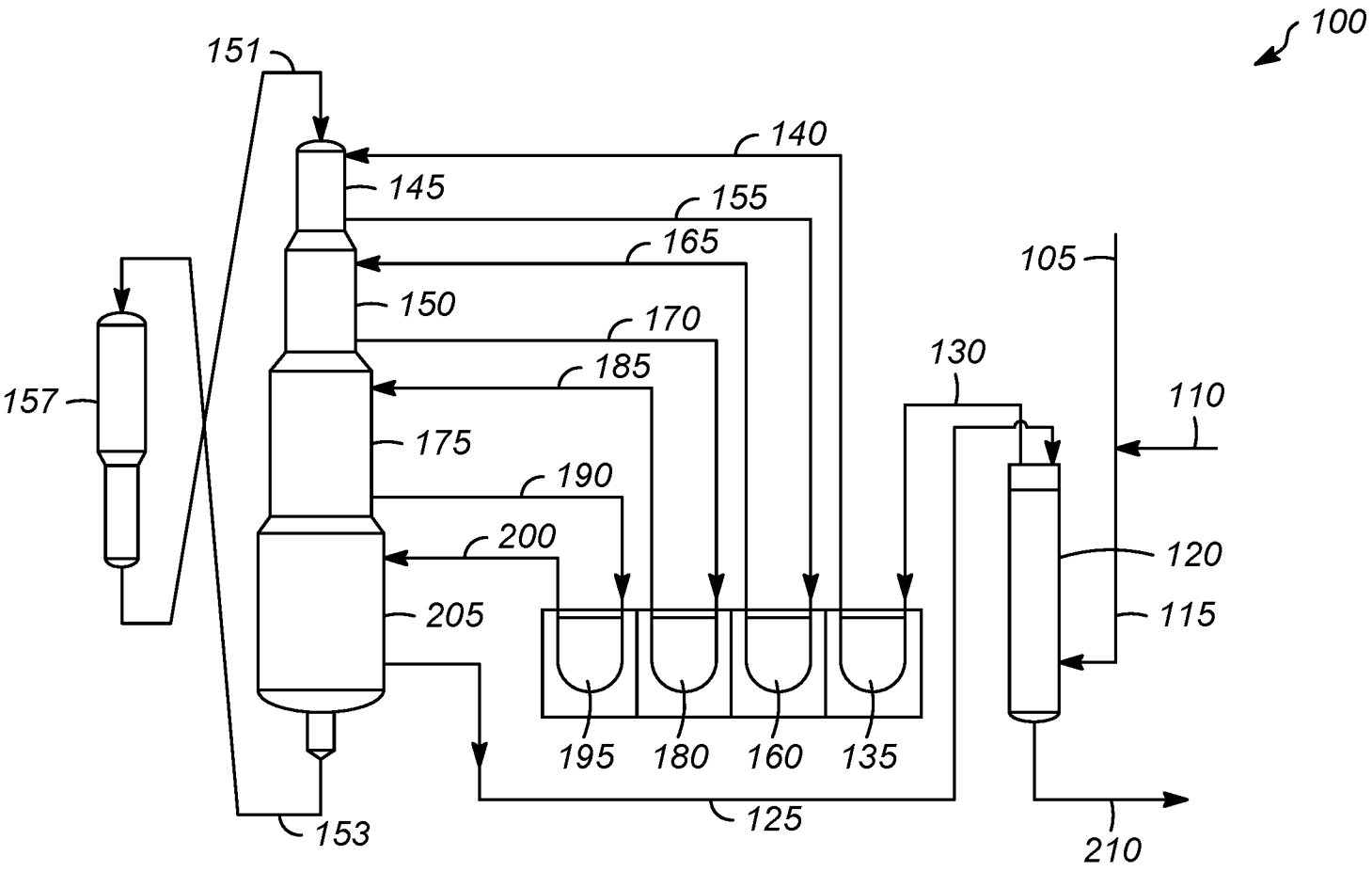
100
110
120
115
105
210
130
135
140
160
125
155
165
180
170
185
195
190
200
145
150
175
205
153
151
157

CATALYST STAGING IN CATALYTIC REACTION PROCESS

CROSS-REFERENCE TO RELATED APPLICATIONS

This application is a Continuation of International Application No. PCT/US2016/056507 filed Oct. 12, 2016, which application claims priority from U.S. Provisional Application No. 62/240,638 filed Oct. 13, 2015, the contents of which cited applications are hereby incorporated by reference in their entirety

BACKGROUND OF THE INVENTION

Hydrocarbon conversion processes often employ multiple reaction zones through which hydrocarbons pass in a series flow. Each reaction zone in the series often has a unique set of design requirements. A minimum design requirement of each reaction zone in the series is the hydraulic capacity to pass the desired throughput of hydrocarbons. An additional design requirement of each reaction zone is sufficient heating to perform a specified degree of hydrocarbon conversion.

One well-known hydrocarbon conversion process is catalytic reforming. Generally, catalytic reforming is a well-established hydrocarbon conversion process employed in the petroleum refining industry for improving the octane quality of hydrocarbon feedstocks. The primary products of reforming are a motor gasoline blending component or aromatics for petrochemicals. Reforming may be defined as the total effect produced by dehydrogenation of cyclohexanes and dehydroisomerization of alkylcyclopentanes to yield aromatics, dehydrogenation of paraffins to yield olefins, dehydrocyclization of paraffins and olefins to yield aromatics, isomerization of n-paraffins, isomerization of alkylcycloparaffins to yield cyclohexanes, isomerization of substituted aromatics, and hydrocracking of paraffins. A reforming feedstock can be a hydrocracker, straight run, FCC, or coker naphtha, and it can contain many other components such as a condensate or thermal cracked naphtha.

With catalytic reforming, the most important factor in improving the octane of naphtha is aromatics formation. However, aromatic formation is also the most important contributor to naphtha volume loss. In addition, the aromatics content of gasoline is controlled by environmental regulations, such as the EURO V specification, which can be particularly difficult to meet.

Therefore, there is a need for methods of improving octane in gasoline without an excessive increase in the aromatic content of the gasoline.

SUMMARY OF THE INVENTION

One aspect of the invention involves a process. In one embodiment, the process includes introducing a hydrocarbon stream comprising hydrocarbons having 5 to 12 carbon atoms into a reforming zone containing reforming catalyst, the reforming zone comprising at least two reformers, each reformer having a set of reforming operating conditions, to produce a reformate effluent, wherein the last reformer contains less catalyst than the next to the last reformer.

BRIEF DESCRIPTION OF THE DRAWING

The FIGURE illustrates one embodiment of catalytic reforming process.

DETAILED DESCRIPTION OF THE INVENTION

In conventional catalytic reforming, the last reactor is typically the largest in order to help maximize aromatics formation for a given severity. In contrast, in the present invention, the last reactor is the smallest. The process involves catalyst volume staging (in some embodiments combined with temperature staging) to direct the first reactors in a series towards aromatics formation, followed by a final stage in which olefin and isoparaffin formation are favored. This provides significant economic advantages for customers and greater flexibility in meeting blending specifications.

The present invention has identified a novel approach towards reactor circuit process design and control that enables a greater contribution to octane through iso-paraffin and olefinic species. The transformation of low-octane paraffins to isoparaffins and olefinic species are among the fastest reactions within catalyst reforming, and these reactions occur in parallel to the primary dehydrocyclization reaction. Given that the dehydrocyclization reaction is highly endothermic, the operation conditions are not optimal for the formation of olefins and iso-paraffinic species.

In a conventional catalytic reforming process, the distribution of catalyst in four reactors could be about 10-30 vol %, 15-35 vol %, 20-40 vol %, and 30-50 vol % among four reformers operating at about 538° C. (1000° F.).

The present invention utilizes a catalyst distribution in which the last reformer contains less catalyst than the next to the last reformer. In some embodiments, the last reformer contains less catalyst than any other reformer. In some embodiments, the last reformer contains less than about 25 vol % of the total catalyst in the system, or less about 20 vol %, or less than about 15 vol %.

In some embodiments, the difference between the percentage of the total catalyst in the last reformer and the percentage of the total catalyst in the next to the last reformer is at least about 10%. For example, if the last reformer contains 25% of the catalyst, the next to the last reformer will contain 35% or more of the catalyst.

In some embodiments, the first reformer contains about 10% to about 35% of the total catalyst, the second reformer contains about 25% to about 35% of the total catalyst, the third reformer contains about 35% to about 45% of the total catalyst, and the fourth reformer contains about 10 to about 25% of the total catalyst.

In some embodiments, this catalyst distribution is combined with an ascending temperature profile so that the last reactor has the highest temperature. In some embodiments, the last reformer has an operating temperature of greater than about 540° C. In some embodiments, when there are four reformers in the reforming zone, the first reformer is operated at a temperature of about 480° C. to about 560° C., the second reformer is operated at a temperature of about 510° C. to about 560° C., the third reformer is operated at a temperature of about 520° C. to about 560° C., and the fourth reformer is operated at a temperature of about 540° C. to about 560° C., with each successive reactor being operated at a temperature higher than the previous reactor.

In some embodiments, the last reactor also has high space velocity to limit the endotherm from aromatics formation so that higher levels of paraffin dehydrogenation and isomerization reactions are maintained. In some embodiments, the liquid hourly space velocity (LHSV) of the last reformer is greater than about 10 $hr^{-1}$. In some embodiments, the LHSV of the last reformer is greater than the LHSV of any of the other reformers. In some embodiments, when there are four reformers in the reforming zone, the LHSV of the first reformer is about 8.5 $hr^{-1}$ to about 20 $hr^{-1}$, the LHSV of the second reformer is about 8.5 $hr^{-1}$ to about 12 $hr^{-1}$, the LHSV of the third reformer is about 6.5 $hr^{-1}$ to about 8.5 $hr^{-1}$, and the LHSV of the fourth reformer is about 12 $hr^{-1}$ to about 30 $hr^{-1}$.

The reforming zone includes at least two reformers with heaters between the reformers. The hydrocarbon stream passes from one reformer through a heater and into the next reformer. Typically, there is a heater between any two reformers in series. There will typically be a heater or a heat exchanger before the first reformer to heat the incoming stream. There can be three, four, five, or more reformers and three, four, five, or more heaters.

Generally, the catalytic reforming zone has at least two reformers where the reactant stream flows serially through the reformers. Reaction systems having multiple reformers generally take one of two forms: a side-by-side form or a stacked form. In the side-by-side form, multiple and separate reaction vessels, each that can include a reformer, may be placed along side each other. In the stacked form, one common reaction vessel can contain multiple and separate reformers that may be placed on top of each other. In both reaction systems, there can be intermediate heating or cooling between the reformers, depending on whether the reactions can be endothermic or exothermic.

Although the reforming zones can include any number of arrangements for hydrocarbon flow such as downflow, upflow, and crossflow, the most common reaction zone to which this invention is applied may be radial flow. A radial flow reaction zone generally includes cylindrical sections having varying nominal cross-sectional areas, vertically and coaxially disposed to form the reaction zone. Briefly, a radial flow reaction zone typically includes a cylindrical reaction vessel containing a cylindrical outer catalyst retaining screen and a cylindrical inner catalyst retaining screen that are both coaxially-disposed within the reaction vessel. The inner screen may have a nominal, internal cross-sectional area that is less than that of the outer screen, which can have a nominal, internal cross-sectional area that is less than that of the reaction vessel. Generally, the reactant stream is introduced into the annular space between the inside wall of the reaction vessel and the outside surface of the outer screen. The reactant stream can pass through the outer screen, flow radially through the annular space between the outer screen and the inner screen, and pass through the inner screen. The stream that may be collected within the cylindrical space inside the inner screen can be withdrawn from the reaction vessel. Although the reaction vessel, the outer screen, and the inner screen may be cylindrical, they may also take any suitable shape, such as triangular, square, oblong, or diamond, depending on many design, fabrication, and technical considerations. As an example, generally it is common for the outer screen to not be a continuous cylindrical screen but to instead be an arrangement of separate, semi-elliptical, tubular screens called scallops that may be arrayed around the circumference of the inside wall of the reaction vessel. The inner screen is commonly a perforated center pipe that may be covered around its outer circumference with a screen.

In some embodiments, the catalytic conversion processes include catalyst that can include particles that are movable through the reaction zones. The catalyst particles may be movable through the reaction zone by any number of motive devices, including conveyors or transport fluid, but most commonly the catalyst particles are movable through the reaction zone by gravity. Typically, in a radial flow reaction zone, the catalyst particles can fill the annular space between the inner and outer screens, which may be called the catalyst bed. Catalyst particles can be withdrawn from a bottom portion of a reaction zone, and catalyst particles may be introduced into a top portion of the reaction zone. The catalyst particles withdrawn from the final reaction zone can subsequently be recovered from the process, regenerated in a regeneration zone of the process, or transferred to another reaction zone. Likewise, the catalyst particles added to a reaction zone can be catalyst that is being newly added to the process, catalyst that has been regenerated in a regeneration zone within the process, or catalyst that is transferred from another reaction zone.

Illustrative reaction vessels that have stacked reaction zones are disclosed in U.S. Pat. Nos. 3,706,536 and 5,130,106, the teachings of which are incorporated herein by reference in their entirety. Generally, the transfer of the gravity-flowing catalyst particles from one reaction zone to another, the introduction of fresh catalyst particles, and the withdrawal of spent catalyst particles are effected through catalyst transfer conduits.

Further information on reforming processes may be found in, for example, U.S. Pat. Nos. 4,119,526; 4,409,095; and 4,440,626.

The feedstocks converted by these processes can include various fractions from a range of crude oils. Exemplary feedstocks converted by these processes generally include naphtha, including, but not limited to, straight run naphtha, hydrocracked naphtha, visbreaker naphtha, coker naphtha, and fluid catalytic cracked naphtha. Light naphtha including some butane, pentanes, and light hexanes may also be included in the feedstock.

Usually, in catalytic reforming, a feedstock is admixed with a recycle stream comprising hydrogen to form what is commonly referred to as a combined feed stream, and the combined feed stream is contacted with a catalyst in a reaction zone. The usual feedstock for catalytic reforming is a petroleum fraction known as naphtha and having an initial boiling point of about 82° C. (about 180° F.), and an end boiling point of about 203° C. (about 400° F.). The catalytic reforming process is particularly applicable to the treatment of straight run naphthas comprised of relatively large concentrations of naphthenic and substantially straight chain paraffinic hydrocarbons, which are subject to aromatization through dehydrogenation and/or cyclization reactions. The preferred charge stocks are naphthas consisting principally of naphthenes and paraffins that can boil within the gasoline range, although, in many cases, aromatics also can be present. This preferred class includes straight-run gasolines, natural gasolines, synthetic gasolines, and the like. As an alternative embodiment, it is frequently advantageous to charge thermally or catalytically cracked gasolines or partially reformed naphthas. Mixtures of straight-run and cracked gasoline-range naphthas can also be used to advantage. The gasoline-range naphtha charge stock may be a full-boiling gasoline having an initial boiling point of about 40 to about 82° C. (about 104 to about 180° F.) and an end boiling point within the range of about 160 to about 220° C. (about 320 to about 428° F.), or may be a selected fraction thereof which generally can be a higher-boiling fraction commonly referred to as a heavy naphtha, for example, a naphtha boiling in the range of about 100 to about 200° C. (about 212 to about 392° F.). In some cases, it is also advantageous to charge pure hydrocarbons or mixtures of hydrocarbons that have been recovered from extraction units, for example, raffinates from aromatics extraction or straight-chain paraffins, which are to be converted to aromatics. In some other cases, the feedstock may also contain light hydrocarbons that have 1-5 carbon atoms, but since these light hydrocarbons cannot be readily reformed into aromatic hydrocarbons, these light hydrocarbons entering with the feedstock are generally minimized.

An exemplary flow through the train of heating and reaction zones is a 4-reaction zone catalytic reforming process, having first, second, third and fourth reformers, which can be described as follows.

The FIGURE illustrates one embodiment of the reforming process 100. A naphtha-containing hydrocarbon feedstock 105 can admix with a hydrogen-containing recycle gas 110 to form a combined feed stream 115, which may pass through a combined feed heat exchanger 120. In the combined feed heat exchanger 120, the combined feed stream 115 can be heated by exchanging heat with the effluent stream 125 of the fourth reformer. However, the heating of the combined feed stream 115 that occurs in the combined feed heat exchanger 120 is generally insufficient to heat the combined feed stream to the desired inlet temperature of the first reformer.

Generally, hydrogen is supplied to provide an amount of about 1 to about 20 moles of hydrogen per mole of hydrocarbon feedstock entering the reforming zones. Hydrogen is preferably supplied to provide an amount of less than about 3.5 moles of hydrogen per mole of hydrocarbon feedstock entering the reforming zones. If hydrogen is supplied, it may be supplied upstream of the combined feed heat exchanger 120, downstream of the combined feed heat exchanger 120, or both upstream and downstream of the combined feed heat exchanger 120. Alternatively, no hydrogen may be supplied before entering the reforming zones with the hydrocarbon feedstock. Even if hydrogen is not provided with the hydrocarbon feedstock 105 to the first reformer, the naphthene reforming reactions that occur within the first reformer can yield hydrogen as a by-product. This by-product, or in-situ-produced, hydrogen leaves the first reformer in an admixture with the first reformer effluent and then can become available as hydrogen to the second reformer and other downstream reformers. This in situ hydrogen in the first reformer effluent usually amounts to about 0.5 to about 2 moles of hydrogen per mole of hydrocarbon feedstock.

Usually, the combined feed stream 115 (or the hydrocarbon feedstock 105 if no hydrogen is provided with the hydrocarbon feedstock) enters the combined feed heat exchanger 120 at a temperature of generally about 38° C. to about 177° C. (about 100° F. to about 350° F.), and more usually about 93° C. to about 121° C. (about 200° F. to about 250° F.). Because hydrogen is usually provided with the hydrocarbon feedstock, this heat exchanger may be referred to herein as the combined feed heat exchanger 120, even if no hydrogen is supplied with the hydrocarbon feedstock. Generally, the combined feed heat exchanger 120 heats the combined feed stream 115 by transferring heat from the effluent stream 125 of the last reforming reaction zone to the combined feed stream 115. Preferably, the combined feed heat exchanger 120 is an indirect, rather than a direct, heat exchanger, in order to prevent valuable reformate product in the last reaction zone's effluent stream 125 from intermixing with the combined feed stream 115 where the reformate quality could be degraded.

Although the flow pattern of the combined feed stream 115 and the last reaction zone effluent stream 125 within the combined feed heat exchanger 120 could be completely co-current, reversed, mixed, or cross flow, the flow pattern is preferably countercurrent. By a countercurrent flow pattern, it is meant that the combined feed stream 115, while at its coldest temperature, contacts one end (i.e., the cold end) of the heat exchange surface of the combined feed heat exchanger 120 while the last reaction zone effluent stream 125 contacts the cold end of the heat exchange surface at its coldest temperature as well. Thus, the last reaction zone effluent stream 125, while at its coldest temperature within the heat exchanger, exchanges heat with the combined feed stream 115 that is also at its coldest temperature within the combined feed heat exchanger 120. At another end (i.e., the hot end) of the combined feed heat exchanger surface, the last reaction zone effluent stream 125 and the combined feed stream 115, both at their hottest temperatures within the combined feed heat exchanger 120, contact the hot end of the heat exchange surface and thereby exchange heat. Between the cold and hot ends of the heat exchange surface, the last reaction zone effluent stream 125 and the combined feed stream 115 flow in generally opposite directions, so that, in general, at any point along the heat transfer surface, the hotter the temperature of the last reaction zone effluent stream 125, the hotter is the temperature of the combined feed stream 115 with which the last reaction zone effluent stream exchanges heat. For further information on flow patterns in heat exchangers, see, for example, pages 10-24 to 10-31 of Perry's Chemical Engineers' Handbook, Sixth Edition, edited by Robert H. Perry et al., published by McGraw-Hill Book Company in New York, in 1984, and the references cited therein.

Generally, the combined feed heat exchanger 120 operates with a hot end approach that is generally less than a difference of about 56° C. (about 100° F.), or less than a difference of about 33° C. (about 60° F.), or less than a difference of about 28° C. (about 50° F.). As used herein, the term "hot end approach" is defined as follows: based on a heat exchanger that exchanges heat between a hotter last reaction zone effluent stream and a colder combined feed stream, where T1 is the inlet temperature of the last reaction zone effluent stream, T2 is the outlet temperature of the last reaction zone effluent stream, t1 is the inlet temperature of the combined feed stream, and t2 is the outlet temperature of the combined feed stream. Then, as used herein, for a countercurrent heat exchanger, the "hot end approach" is defined as the difference between T1 and t2. In general, the smaller the hot end approach, the greater is the degree to which the heat in the last reaction zone's effluent is exchanged to the combined feed stream.

Although shell-and-tube type heat exchangers may be used, another possibility is a plate type heat exchanger. Plate type exchangers are well known and commercially available in several different and distinct forms, such as spiral, plate and frame, brazed-plate fin, and plate fin-and-tube types. Plate type exchangers are described generally on pages 11-21 to 11-23 in Perry's Chemical Engineers' Handbook, Sixth Edition, edited by R. H. Perry et al., and published by McGraw Hill Book Company, in New York, in 1984.

In one embodiment, the combined feed stream 130 can leave the combined feed heat exchanger 120 at a temperature of about 399° C. to about 516° C. (about 750° F. to about 960° F.).

Consequently, after exiting the combined feed heat exchanger 120 and prior to entering the first reformer, the combined feed stream 130 often requires additional heating. This additional heating can occur in a charge heater 135, which is commonly referred to as a charge heater, which can heat the combined feed stream 130 to the desired inlet temperature of the first reformer 145. Such a heater can be a gas-fired, an oil-fired, or a mixed gas-and-oil-fired heater, of a kind that is well known to persons of ordinary skill in the art of reforming. The charge heater 135 may heat the combined feed stream 130 by radiant and/or convective heat transfer. Commercial fired heaters for reforming processes typically have individual radiant heat transfer sections for individual heaters, and an optional common convective heat transfer section that is heated by the flue gases from the radiant sections.

The temperature of the combined feed stream 140 leaving the charge heater 135, which may also be the inlet temperature of the first reformer 145, is generally about 450° C. to about 560° C. (about 842° F. to about 1040° F.), or about 500° C. to about 530° C. (about 932° F. to about 986° F.).

Once the combined feed stream 140 passes to the first reformer 145, the combined feed stream 140 may undergo conversion reactions. In a common form, the reforming process can employ the catalyst particles in several reaction zones interconnected in a series flow arrangement. There may be any number of reaction zones, but usually the number of reaction zones is 3, 4 or 5. Because reforming reactions occur generally at an elevated temperature and are generally endothermic, each reaction zone usually has associated with it one or more heating zones, which heat the reactants to the desired reaction temperature.

This invention can be applicable in a reforming reaction system having at least two catalytic reformers where at least a portion of the reactant stream and at least a portion of the catalyst particles flow serially through the reformers. These reforming reaction systems can be a side-by-side form or a stacked form, as discussed above.

Generally, the reforming reactions are normally effected in the presence of catalyst particles comprised of one or more Group VIII (IUPAC 8-10) noble metals (e.g., platinum, iridium, rhodium, and palladium) and a halogen combined with a porous carrier, such as a refractory inorganic oxide. U.S. Pat. No. 2,479,110, for example, teaches an alumina-platinum-halogen reforming catalyst. Although the catalyst may contain about 0.05 to about 2.0 wt-% of Group VIII metal, a less expensive catalyst, such as a catalyst containing about 0.05 to about 0.5 wt-% of Group VIII metal may be used. The preferred noble metal is platinum. In addition, the catalyst may contain indium and/or a lanthanide series metal such as cerium. The catalyst particles may also contain about 0.05 to about 0.5 wt-% of one or more Group IVA (IUPAC 14) metals (e.g., tin, germanium, and lead), such as described in U.S. Pat. Nos. 4,929,333, 5,128,300, and the references cited therein. The halogen is typically chlorine, and alumina is commonly the carrier. Suitable alumina materials include, but are not limited to, gamma, eta, and theta alumina. One property related to the performance of the catalyst is the surface area of the carrier. Preferably, the carrier has a surface area of about 100 to about 500 $m^2/g$. The activity of catalysts having a surface area of less than about 130 $m^2/g$ tend to be more detrimentally affected by catalyst coke than catalysts having a higher surface area. Generally, the particles are usually spheroidal and have a diameter of about 1.6 to about 3.1 mm (about 1/16 to about 1/8 inch), although they may be as large as about 6.35 mm (about 1/4 inch) or as small as about 1.06 mm (about 1/24 inch). In a particular reforming reaction zone, however, it is desirable to use catalyst particles which fall in a relatively narrow size range. A preferred catalyst particle diameter is about 1.6 mm (about 1/16 inch).

A reforming process can employ a fixed catalyst bed, or a moving bed reaction vessel and a moving bed regeneration vessel. In the latter, generally regenerated catalyst particles 151 are fed to the reaction vessel, which typically includes several reaction zones, and the particles flow through the reaction vessel by gravity. Catalyst 153 may be withdrawn from the bottom of the reaction vessel and transported to the regeneration vessel 157. In the regeneration vessel 157, a multi-step regeneration process is typically used to regenerate the catalyst to restore its full ability to promote reforming reactions. U.S. Pat. Nos. 3,652,231; 3,647,680 and 3,692,496 describe catalyst regeneration vessels that are suitable for use in a reforming process. Catalyst can flow by gravity through the various regeneration steps and then be withdrawn from the regeneration vessel 157 and transported to the reaction vessel. Generally, arrangements are provided for adding fresh catalyst as make-up to and for withdrawing spent catalyst from the process. Movement of catalyst through the reaction and regeneration vessels is often referred to as continuous though, in practice, it is semicontinuous. By semicontinuous movement, it is meant the repeated transfer of relatively small amounts of catalyst at closely spaced points in time. For example, one batch every twenty minutes may be withdrawn from the bottom of the reaction vessel and withdrawal may take five minutes, that is, catalyst can flow for five minutes. If the catalyst inventory in a vessel is relatively large in comparison with this batch size, the catalyst bed in the vessel may be considered to be continuously moving. A moving bed system can have the advantage of maintaining production while the catalyst is removed or replaced.

Typically, the rate of catalyst movement through the catalyst beds may range from as little as about 45.5 kg (about 100 pounds) per hour to about 2,722 kg (about 6,000 pounds) per hour, or more.

The reformers of the present invention can be operated at reforming conditions, which include a range of pressures generally from atmospheric pressure of about 0 to about 6,895 kPa(g) (about 0 psi(g) to about 1,000 psi(g)), with particularly good results obtained at the relatively low pressure range of about 276 to about 1,379 kPa(g) (about 40 to about 200 psi(g)).

The first reformer 145 may contain generally about 10% to about 35% of the total catalyst volume in all of the reformers, or about 15% to about 35%, or about 10% to about 25%. Consequently, the liquid hourly space velocity (LHSV) in the first reformer 145, based on the catalyst volume in the first reformer 145, can be generally about 8.5 to about 30 $hr^{-1}$. Generally, the catalyst particles are withdrawn from the first reformer 145 and passed to the second reformer 150; such particles generally have a coke content of less than about 2 wt-% based on the weight of catalyst.

Because of the endothermic reforming reactions that occur in the first reformer 145, generally the temperature of the effluent 155 of the first reformer 145 falls not only to less than the temperature of the combined feed stream 140 to the first reformer 145, but also to less than the desired inlet temperature of the second reformer 150. Therefore, the effluent 155 of the first reformer 145 can pass through another heater 160, which is commonly referred to as the first interheater 160, and which can heat the first reformer effluent 155 to the desired inlet temperature of the second reformer 150.

Generally, a heater 160 is referred to as an interheater when it is located between two reformers, such as the first and second reformers 145, 150. The first reformer effluent 155 is sent to the interheater 160 and heated to the inlet temperature of the second reformer 150 (with allowance for heat loss during transfer). The inlet temperature of the second reformer 150 is generally about 510° C. to about 560° C. The inlet temperature of the second reformer 150 is usually at least about 10° C. greater than the inlet temperature of the first reformer 145.

On exiting the first interheater 160, generally the heated effluent 165 enters the second reformer 150. As in the first reformer 145, the endothermic reactions can cause another decline in temperature across the second reformer 150. Generally, however, the temperature decline across the second reformer 150 is less than the temperature decline across the first reformer 145, because the reactions that occur in the second reformer 150 are generally less endothermic than the reactions that occur in the first reformer 145. Despite the somewhat lower temperature decline across the second reformer 150, the effluent 170 of the second reformer 150 is nevertheless still at a temperature that is less than the desired inlet temperature of the third reformer 175.

The second reformer 150 generally includes about 25% to about 35% of the total catalyst volume in all of the reaction zones. Consequently, the liquid hourly space velocity (LHSV) in the second reformer 150, based on the catalyst volume in the second reformer 150, is generally about 8.5 $hr^{-1}$ to about 12 $hr^{-1}$.

The second reformer effluent 170 can pass a second interheater 180 (the first interheater being the previously described interheater 160 between the first and the second reformers 145, 150), and the heated effluent 185 can pass to the third reformer 175.

The third reformer 175 contains generally about 35% to about 45% of the total catalyst volume in all of the reformers. Consequently, the liquid hourly space velocity (LHSV) in the third reformer 175, based on the catalyst volume in the third reformer 175, is generally about 6.5 $hr^{-1}$ to about 8.5 $hr^{-1}$.

Likewise, the third reformer effluent 190 can pass to a third interheater 195, and the heated effluent 200 passes to a fourth reformer 205. As discussed previously, the fourth reformer 205 contains less catalyst than the third reformer 175. It typically contains less than about 25% of the total amount of catalyst, or less than about 20%, or less than about 15%. The amount of catalyst is the fourth reformer 205 is generally in the range of about 10% to about 25% of the total catalyst volume in all of the reformers, or about 10% to about 20%. The inlet temperature of the fourth reformer 205 is generally about 540° C. to about 560° C. The liquid hourly space velocity (LHSV) in the fourth reformer 205 is generally about 12 $hr^{-1}$ to about 30 $hr^{-1}$.

Because the reforming reactions that occur in the second and subsequent (i.e., third and fourth (or more)) reformers are generally less endothermic than those that occur in the first reformer, the temperature drop that occurs in the later reformers is generally less than that that occurs in the first reformer. Thus, the outlet temperature of the last reformer may be about 30° C. (about 54° F.) or less below the inlet temperature of the last reformer.

The desired reformate octane of the $C_{5+}$ fraction of the reformate is generally about 85 to about 107 clear research octane number ($C_{5+}$ RONC), and preferably about 98 to about 102 $C_{5+}$ RONC.

The fourth reformer effluent stream 125 is cooled in the combined feed heat exchanger 120 by transferring heat to the combined feed stream 115. After leaving the combined feed heat exchanger 120, the cooled effluent 210 from the fourth reformer 205 passes to a product recovery section (not shown). Suitable product recovery sections are known to persons of ordinary skill in the art of reforming. Exemplary product recovery facilities generally include gas-liquid separators for separating hydrogen and $C_1$ through $C_3$ hydrocarbon gases from the last reaction zone effluent stream, and fractionation columns for separating at least a portion of the $C_4$ to $C_5$ light hydrocarbons from the remainder of the reformate. In addition, the reformate may be separated by distillation into a light reformate fraction and a heavy reformate fraction.

During the course of a reforming reaction with a moving catalyst bed, catalyst particles become deactivated as a result of mechanisms such as the deposition of coke on the particles; that is, after a period of time in use, the ability of catalyst particles to promote reforming reactions decreases to the point that the catalyst is no longer useful. The catalyst can be reconditioned, or regenerated, before it is reused in a reforming process.

EXAMPLE

A yield example based on a catalytic reforming kinetic model was calculated. The yield calculations are based on a catalyst specific extension of a kinetic model similar to that described in Catalytic Naphtha Reforming, Antos et al., 2004.

Yield calculations were performed for a conventional design utilizing a catalyst distribution of about 10 vol % in the first reactor, 15 vol % in the second reactor, 25 vol % in the third reactor, and 50 vol % in the fourth reactor. The four reactors were assumed to operate at about 538° C. (about 1000° F.).

Yield calculations were also performed for a catalyst distribution of about 18 vol % in the first reactor, 29 vol % in the second reactor, 41 vol % in the third reactor, and 12 vol % in the fourth reactor. The first reformers are operated with increasing temperature to approach the aromatics target, while the last reformer is staged significantly above about 538° C. (about 1000° F.) (e.g., about 549+° C. (about 1020+° F.)), but operated with high space velocity to limit the endotherm from aromatics formation such that a greater level of paraffin dehydrogenation and isomerization reactions are maintained. The temperature profile is an optimized profile. Olefin equilibrium is favored by higher temperatures and lower pressures.

The catalyst distribution and calculated yields are shown in Tables 1 and 2. As shown in Table 1, for a target 101.3 research octane number (RON) reformate, the example provides a reduced aromatics content of 65 vol % (versus 67 vol % for the conventional case) of the $C_{5+}$ reformate, and an increase in olefin content to 2.5 vol % of the $C_6$-$C_9$ fraction (versus 1.4 vol % for the conventional case).

Table 2 provides typical octane and densities for paraffins (P), olefins (O), and Aromatics (A) within two example carbon numbers, $C_6$ and $C_7$. As shown, aromatics are denser and have a higher octane value than paraffins, with olefins having a density and octane value between aromatics and paraffins.

TABLE 1

| | Conventional | Modified |
|---|---|---|
| RX1, % | 10 | 18 |
| RX2, % | 15 | 29 |
| RX3, % | 25 | 41 |
| RX4, % | 50 | 12 |
| Olefin, % v | 1.4 | 2.5 |
| Aromatics, % v | 67.0 | 65.0 |
| $C_{5+}$, % v | 80.8 | 82.5 |

TABLE 2

| | $C_6$'s | | | $C_7$'s | | |
|---|---|---|---|---|---|---|
| | P | O | A | P | O | A |
| RON | 25 | 76 | 105 | 0 | 55 | 105 |
| S.G. | 0.66 | 0.68 | 0.86 | 0.69 | 0.70 | 0.86 |

By the term "about", we mean within 10% of the value, or within 5%, or within 1%.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

Specific Embodiments

While the following is described in conjunction with specific embodiments, it will be understood that this description is intended to illustrate and not limit the scope of the preceding description and the appended claims.

A first embodiment of the invention is a process comprising introducing a hydrocarbon stream comprising hydrocarbons having 5 to 12 carbon atoms into a reforming zone containing reforming catalyst, the reforming zone comprising at least two reformers, each reformer having a set of reforming operating conditions, to produce a reformate effluent, wherein the last reformer contains less catalyst than the next to the last reformer. An embodiment of the invention is one, any or all of prior embodiments in this paragraph up through the first embodiment in this paragraph wherein the last reformer contains less than catalyst than any other reformer. An embodiment of the invention is one, any or all of prior embodiments in this paragraph up through the first embodiment in this paragraph wherein the last reformer contains less than about 25% of the total catalyst in the reforming zone. An embodiment of the invention is one, any or all of prior embodiments in this paragraph up through the first embodiment in this paragraph wherein a difference between the percentage of the total catalyst in the last reformer and the percentage of the total catalyst in the next to the last reformer is at least about 10%. An embodiment of the invention is one, any or all of prior embodiments in this paragraph up through the first embodiment in this paragraph wherein there are four reformers in the reforming zone, and wherein the first reformer contains about 15% to about 35% of the total catalyst, the second reformer contains about 25% to about 35% of the total catalyst, the third reformer contains about 35% to about 45% of the total catalyst, and wherein the fourth reformer contains about 10 to about 25% of the total catalyst. An embodiment of the invention is one, any or all of prior embodiments in this paragraph up through the first embodiment in this paragraph wherein the reforming zone has an ascending temperature profile. An embodiment of the invention is one, any or all of prior embodiments in this paragraph up through the first embodiment in this paragraph wherein an operating temperature in the last reformer is greater than about 540° C. An embodiment of the invention is one, any or all of prior embodiments in this paragraph up through the first embodiment in this paragraph wherein there are four reformers in the reforming zone, and wherein the first reformer is operated at a temperature of about 480° C. to about 560° C., the second reformer is operated at a temperature of about 510° C. to about 560° C., the third reformer is operated at a temperature of about 520° C. to about 560° C., and the fourth reformer is operated at a temperature of about 540° C. to about 560° C. An embodiment of the invention is one, any or all of prior embodiments in this paragraph up through the first embodiment in this paragraph wherein the LHSV of the last reformer is greater than about 10 $hr^{-1}$. An embodiment of the invention is one, any or all of prior embodiments in this paragraph up through the first embodiment in this paragraph wherein an LHSV of the last reformer is greater than an LHSV of any other reformer. An embodiment of the invention is one, any or all of prior embodiments in this paragraph up through the first embodiment in this paragraph wherein there are four reformers in the reforming zone, and wherein an LHSV of the first reformer is about 8.5 $hr^{-1}$ to about 20 $hr^{-1}$, an LHSV of the second reformer is about 8.5 $hr^{-1}$ to about 12 $hr^{-1}$, an LHSV of the third reformer is about 6.5 $hr^{-1}$ to about 8.5 $hr^{-1}$, and an LHSV of the fourth reformer is about 12 $hr^{-1}$ to about 30 $hr^{-1}$. An embodiment of the invention is one, any or all of prior embodiments in this paragraph up through the first embodiment in this paragraph wherein there are four reformers in the reforming zone and wherein the first reformer contains about 15% to about 35% of the total catalyst, the first reformer is operated at a temperature of about 480° C. to about 560° C., and an LHSV of the first reformer is about 8.5 $hr^{-1}$ to about 20 $hr^{-1}$; the second reformer contains about 25% to about 35% of the total catalyst, the second reformer is operated at a temperature of about 510° C. to about 560° C., and an LHSV of the second reformer is about 8.5 $hr^{-1}$ to about 12 $hr^{-1}$; the third reformer contains about 35% to 45% of the total catalyst, the third reformer is operated at a temperature of about 510° C. to about 560° C., and an LHSV of the third reformer is about 6.5 $hr^{-1}$ to about 8.5 $hr^{-1}$; and the fourth reformer contains about 10% to 25% of the total catalyst, the fourth reformer is operated at a temperature of about 540° C. to about 560° C., and an LHSV of the fourth reformer is about 12 $hr^{-1}$ to about 30 $hr^{-1}$.

A second embodiment of the invention is a process comprising heating a hydrocarbon feed stream comprising hydrocarbons having 5 to 12 carbon atoms; introducing the heated hydrocarbon stream into a reforming zone containing reforming catalyst, the reforming zone comprising at least two reformers, each reformer having a set of reforming operating conditions, to produce a reformate effluent, wherein the last reformer contains less catalyst than the next to the last reformer and less than about 25% of the total catalyst in the reforming zone, and wherein an LHSV of the last reformer is greater than about 10 $hr^{-1}$; and passing the reformat effluent to a reformate splitter to generate a reformate overhead comprising C6 and C7 aromatics, and a bottoms stream comprising heavier hydrocarbons. An embodiment of the invention is one, any or all of prior embodiments in this paragraph up through the second embodiment in this paragraph wherein the last reformer contains less than catalyst than any other reformer. An embodiment of the invention is one, any or all of prior embodiments in this paragraph up through the second embodiment in this paragraph wherein an operating temperature in the last reformer is greater than about 540° C. and wherein an LHSV of the last reformer is greater than an LHSV of any other reformer. An embodiment of the invention is one, any or all of prior embodiments in this paragraph up through the second embodiment in this paragraph wherein there are four reformers in the reforming zone, and wherein the first reformer contains about 15% to about 35% of the total catalyst, the second reformer contains about 25% to about 35% of the total catalyst, the third reformer contains about 35% to about 45% of the total catalyst, and wherein the fourth reformer contains less than about 25% of the total catalyst. An embodiment of the invention is one, any or all of prior embodiments in this paragraph up through the second embodiment in this paragraph wherein there are four reformers in the reforming zone, and wherein the first reformer is operated at a temperature of about 480° C. to about 560° C., the second reformer is operated at a temperature of about 510° C. to about 560° C., the third reformer is operated at a temperature of about 520° C. to about 560° C., and the fourth reformer is operated at a temperature of about 540° C. to about 560° C. An embodiment of the invention is one, any or all of prior embodiments in this paragraph up through the second embodiment in this paragraph wherein there are four reformers in the reforming zone, and wherein an LHSV of the first reformer is about 8.5 $hr^{-1}$ to about 20 $hr^{-1}$, an LHSV of the second reformer is about 8.5 $hr^{-1}$ to about 12 $hr^{-1}$, an LHSV of the third reformer is about 6.5 $hr^{-1}$ to about 8.5 $hr^{-1}$, and an LHSV of the fourth reformer is about 12 $hr^{-1}$ to about 30 $hr^{-1}$. An embodiment of the invention is one, any or all of prior embodiments in this paragraph up through the second embodiment in this paragraph wherein there are four reformers in the reforming zone and wherein the first reformer contains about 15% to about 35% of the total catalyst, the first reformer is operated at a temperature of about 480° C. to about 560° C., and an LHSV of the first reformer is about 8.5 $hr^{-1}$ to about 20 $hr^{-1}$; the second reformer contains about 25% to about 35% of the total catalyst, the second reformer is operated at a temperature of about 510° C. to about 560° C., and an LHSV of the second reformer is about 8.5 $hr^{-1}$ to about 12 $hr^{-1}$; the third reformer contains about 35% to 45% of the total catalyst, the third reformer is operated at a temperature of about 510° C. to about 560° C., and an LHSV of the third reformer is about 6.5 $hr^{-1}$ to about 8.5 $hr^{-1}$; and the fourth reformer contains less than about 15% of the total catalyst, the fourth reformer is operated at a temperature of about 540° C. to about 560° C., and an LHSV of the fourth reformer is about 12 $hr^{-1}$ to about 30 $hr^{-1}$. An embodiment of the invention is one, any or all of prior embodiments in this paragraph up through the second embodiment in this paragraph wherein the reforming zone has an ascending profile.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A reforming process comprising:

introducing a hydrocarbon stream comprising hydrocarbons having 5 to 12 carbon atoms into a reforming zone containing reforming catalyst, the reforming zone comprising four sequential reformers and wherein the hydrocarbon stream is introduced into the first reformer, each reformer having a set of reforming operating conditions, to produce a reformate effluent, wherein the first reformer contains about 15% to about 35% of the total catalyst, the second reformer contains about 25% to about 35% of the total catalyst, the third reformer contains about 35% to about 45% of the total catalyst, and wherein the fourth reformer contains about 10 to about 25% of the total catalyst, wherein the reforming zone has an ascending temperature profile so that the fourth reformer has the highest temperature, and wherein an operating temperature in the fourth reformer is greater than about 540° C.

2. The reforming process of claim 1 wherein a difference between the percentage of the total catalyst in the last reformer and the percentage of the total catalyst in the next to the last reformer is at least about 10%.

3. The reforming process of claim 1 wherein an operating temperature in the fourth reformer is greater than about 540° C.

4. The reforming process of claim 1 wherein the first reformer is operated at a temperature of about 480° C. to about 560° C., the second reformer is operated at a temperature of about 510° C. to about 560° C., the third reformer is operated at a temperature of about 520° C. to about 560° C., and the fourth reformer is operated at a temperature of about 540° C. to about 560° C.

5. The reforming process of claim 1 wherein the LHSV of the fourth reformer is greater than about 12 $hr^{-1}$.

6. The reforming process of claim 1 wherein an LHSV of the fourth reformer is greater than an LHSV of the first reformer, the second reformer, and the third reformer.

7. The reforming process of claim 1 wherein an LHSV of the first reformer is about 8.5 $hr^{-1}$ to about 20 $hr^{-1}$, an LHSV of the second reformer is about 8.5 $hr^{-1}$ to about 12 $hr^{-1}$, an LHSV of the third reformer is about 6.5 $hr^{-1}$ to about 8.5 $hr^{-1}$, and an LHSV of the fourth reformer is about 12 $hr^{-1}$ to about 30 $hr^{-1}$.

8. The reforming process of claim 1 wherein:

the first reformer is operated at a temperature of about 480° C. to about 560° C., and an LHSV of the first reformer is about 8.5 $hr^{-1}$ to about 20 $hr^{-1}$;

the second reformer is operated at a temperature of about 510° C. to about 560° C., and an LHSV of the second reformer is about 8.5 $hr^{-1}$ to about 12 $hr^{-1}$;

the third reformer is operated at a temperature of about 510° C. to about 560° C., and an LHSV of the third reformer is about 6.5 $hr^{-1}$ to about 8.5 $hr^{-1}$; and the fourth reformer is operated at a temperature of about 540° C. to about 560° C., and an LHSV of the fourth reformer is about 12 $hr^{-1}$ to about 30 $hr^{-1}$.

9. A reforming process comprising:

heating a hydrocarbon feed stream comprising hydrocarbons having 5 to 12 carbon atoms;

introducing the heated hydrocarbon stream into a reforming zone containing reforming catalyst, the reforming zone comprising four reformers, each reformer having a set of reforming operating conditions, to produce a reformate effluent, wherein the first reformer contains about 15% to about 35% of the total catalyst, the second reformer contains about 25% to about 35% of the total catalyst, the third reformer contains about 35% to about 45% of the total catalyst, and wherein the fourth reformer contains about 10 to about 25% of the total catalyst, and wherein an LHSV of the last reformer is greater than about 10 $hr^{-1}$; and passing the reformate effluent to a reformate splitter to generate a reformate overhead comprising C6 and C7 aromatics, and a bottoms stream comprising heavier hydrocarbons.

10. The reforming process of claim 9 wherein an operating temperature in the fourth reformer is greater than about 540° C. and wherein an LHSV of the fourth reformer is greater than an LHSV of any other reformer.

11. The reforming process of claim 9 wherein the first reformer is operated at a temperature of about 480° C. to about 560° C., the second reformer is operated at a temperature of about 510° C. to about 560° C., the third reformer is operated at a temperature of about 520° C. to about 560° C., and the fourth reformer is operated at a temperature of about 540° C. to about 560° C.

12. The reforming process of claim 9 wherein an LHSV of the first reformer is about 8.5 $hr^{-1}$ to about 20 $hr^{-1}$, an LHSV of the second reformer is about 8.5 $hr^{-1}$ to about 12 $hr^{-1}$, an LHSV of the third reformer is about 6.5 $hr^{-1}$ to about 8.5 $hr^{-1}$, and the LHSV of the fourth reformer is about 12 $hr^{-1}$ to about 30 $hr^{-1}$.

13. The reforming process of claim 9 wherein:

the first reformer is operated at a temperature of about 480° C. to about 560° C., and an LHSV of the first reformer is about 8.5 $hr^{-1}$ to about 20 $hr^{-1}$;

the second reformer is operated at a temperature of about 510° C. to about 560° C., and an LHSV of the second reformer is about 8.5 $hr^{-1}$ to about 12 $hr^{-1}$;

the third reformer is operated at a temperature of about 510° C. to about 560° C., and an LHSV of the third reformer is about 6.5 $hr^{-1}$ to about 8.5 $hr^{-1}$; and the fourth reformer is operated at a temperature of about 540° C. to about 560° C., and the LHSV of the fourth reformer is about 12 $hr^{-1}$ to about 30 $hr^{-1}$.

14. The reforming process of claim 9 wherein the reforming zone has an ascending temperature profile so that the fourth reformer has the highest temperature.

15. A reforming process comprising:

introducing a hydrocarbon stream comprising hydrocarbons having 5 to 12 carbon atoms into a reforming zone containing reforming catalyst, the reforming zone comprising four reformers, each reformer having a set of reforming operating conditions, to produce a reformate effluent, wherein the first reformer contains about 25% to about 35% of the total catalyst, the second reformer contains about 25% to about 35% of the total catalyst, the third reformer contains about 35% to about 45% of the total catalyst, and wherein the fourth reformer contains about 10 to about 25% of the total catalyst, wherein an operating temperature in the fourth reformer is greater than about 540° C. and wherein an LHSV of the fourth reformer is greater than an LHSV of any other reformer.

16. The reforming process of claim 1 wherein the reforming zone has an ascending temperature profile so that the fourth reformer has the highest temperature.

17. The reforming process of claim 1 wherein the first reformer is operated at a temperature of about 480° C. to about 560° C., the second reformer is operated at a temperature of about 510° C. to about 560° C., the third reformer is operated at a temperature of about 520° C. to about 560° C., and the fourth reformer is operated at a temperature of about 540° C. to about 560° C.

18. The reforming process of claim 1 wherein an LHSV of the first reformer is about 8.5 $hr^{-1}$ to about 20 $hr^{-1}$, an LHSV of the second reformer is about 8.5 $hr^{-1}$ to about 12 $hr^{-1}$, an LHSV of the third reformer is about 6.5 $hr^{-1}$ to about 8.5 $hr^{-1}$, and an LHSV of the fourth reformer is about 12 $hr^{-1}$ to about 30 $hr^{-1}$.

19. The reforming process of claim 1 wherein:

the first reformer is operated at a temperature of about 480° C. to about 560° C., and an LHSV of the first reformer is about 8.5 $hr^{-1}$ to about 20 $hr^{-1}$;

the second reformer is operated at a temperature of about 510° C. to about 560° C., and an LHSV of the second reformer is about 8.5 $hr^{-1}$ to about 12 $hr^{-1}$;

the third reformer is operated at a temperature of about 510° C. to about 560° C., and an LHSV of the third reformer is about 6.5 $hr^{-1}$ to about 8.5 $hr^{-1}$; and the fourth reformer is operated at a temperature of about 540° C. to about 560° C., and an LHSV of the fourth reformer is about 12 $hr^{-1}$ to about 30 $hr^{-1}$.

20. The reforming process of claim 1 wherein the fourth reformer contains less catalyst than any other reformer.

* * * * *